US009051032B2

(12) United States Patent
Hanel

(10) Patent No.: US 9,051,032 B2
(45) Date of Patent: Jun. 9, 2015

(54) FLOATING CHAIR

(71) Applicant: Chris Hanel, Oakland Park, FL (US)

(72) Inventor: Chris Hanel, Oakland Park, FL (US)

(73) Assignee: Christopher B. Hanel, Fort Lauderdale, FL (US)

( * ) Notice: Subject to any disclaimer, the term of this patent is extended or adjusted under 35 U.S.C. 154(b) by 0 days.

(21) Appl. No.: 13/862,175

(22) Filed: Apr. 12, 2013

(65) Prior Publication Data

US 2014/0308861 A1 Oct. 16, 2014

Related U.S. Application Data

(60) Provisional application No. 61/753,315, filed on Jan. 16, 2013.

(51) Int. Cl.
*B63B 35/74* (2006.01)
*A47C 15/00* (2006.01)

(52) U.S. Cl.
CPC ..... *B63B 35/74* (2013.01); *A47C 15/006* (2013.01); *A63B 2225/605* (2013.01)

(58) Field of Classification Search
CPC ..... B63B 35/74; B63B 35/76; B63B 35/78; A47C 15/006; A63B 2225/60; A63B 2225/605; A63G 31/007
USPC ..... 441/80–88, 125–136; 472/128, 129; D21/678, 803, 804, 809
See application file for complete search history.

(56) References Cited

U.S. PATENT DOCUMENTS

| | | | | | |
|---|---|---|---|---|---|
| 3,380,088 | A * | 4/1968 | D Adesky | 5/420 |
| 4,358,866 | A * | 11/1982 | Rhodes | 114/363 |
| 4,861,300 | A * | 8/1989 | Casagrande et al. | 441/81 |
| 5,088,723 | A * | 2/1992 | Simmons | 472/129 |
| 5,441,006 | A * | 8/1995 | Wood | 114/220 |
| 5,520,561 | A | 5/1996 | Langenohl | |
| 5,571,036 | A | 11/1996 | Hannigan | |
| 6,056,613 | A * | 5/2000 | Pike | 441/129 |
| 6,485,344 | B2 | 11/2002 | Arias | |
| 6,843,695 | B1 * | 1/2005 | Jackson et al. | 441/129 |
| 7,029,355 | B1 * | 4/2006 | Smith | 441/130 |
| 7,364,486 | B2 * | 4/2008 | Serpa | 441/80 |
| 7,955,226 | B2 * | 6/2011 | Dauben | 482/55 |
| 7,998,031 | B2 | 8/2011 | Dumke et al. | |
| 8,137,031 | B2 * | 3/2012 | Meyers et al. | 405/215 |
| 2012/0252293 | A1 * | 10/2012 | Romzek | 441/129 |

* cited by examiner

*Primary Examiner* — Ajay Vasudeva

(57) ABSTRACT

A buoyant, submersible chair that is comprised of a framework of buoyant foam tube sections and a support assembly of rope and buoyant foam tube sections that may be broken down into smaller units that is used to float a user in a body of water. The present invention is lightweight, buoyant, adjustable for personal preference of flotation and comfort, and can be carried on the back in a way that is similar to a back-pack. The present invention is proposed in several different embodiments, each style having numerous seating positions.

21 Claims, 10 Drawing Sheets

FLOATING CHAIR

CROSS REFERENCE TO RELATED APPLICATIONS

Provisional Patent application No. 61/753,315 precedes this non-provisional application.

STATEMENT REGARDING FEDERALLY SPONSORED RESEARCH

Not Applicable

REFERENCE TO A SEQUENCE LISTING, A TABLE, OR A COMPUTER PROGRAM, LISTING COMPACT DISC APPENDIX

Not Applicable

BACKGROUND OF THE INVENTION

The present invention relates to the field of swimming pool accessories and more specifically the present invention relates to buoyant or floating chairs. There are a number of devices for sale on the market that use an inflatable air bladder to float a user as in U.S. Pat. No. 6,485,344. These devices are easily manufactured and inexpensive but are always in danger of being popped or leaking air. There are many devices that float a user above the water line that should not be compared to the present invention since the present invention floats the majority of the user's body below the water line. There are some inventions that incorporate buoyant closed cell foam tubing over a rigid frame as in U.S. Pat. No. 7,998,031, but do not incorporate lengths of rope that affix to the rigid frame members that are weaved through the hollow of straight, rigid, tube members and or closed-cell foam tube sections to form a flexible and adjustable support assembly that serve to cradle and support the weight of a user as the back and seat of a reclined chair would. Other inventions such as U.S. Pat. No. 5,520,561 and U.S. Pat. No. 5,571,036 use a buoyant pool noodle inserted into a fabric webbing with no structural members. Any fabric webbing has the disadvantage of having to be cut, sewn and seamed which means more manufacturing time will be necessary in production. The obvious benefits that all of these products would strive to be able to offer, are ease of manufacturing, use of inexpensive materials, small or collapsible size for shipping, design appeal, functionality and durability as well as variations in style, function and characteristics that create wide ranging appeal. Most, if not all of the conventional floating chairs are missing at least one of the afore-mentioned benefits.

It is thus an object of the present invention to provide an easily built and inexpensive floating chair. It is another object of the present invention to provide a collapsible floating chair for easy storage and shipment. It is still another object of the present invention to provide a floating chair with variations in style and function that would better appeal to a wide market. It is finally an object of the present invention to provide a functional and durable floating chair that is designed to be customized by the user, to that user's own specifications.

BRIEF SUMMARY OF THE INVENTION

The present invention accomplishes the above-stated objectives, as well as others, as may be determined by a fair reading and interpretation of the entire specification. The present invention consists of two main parts, wherein part one is a rigid frame that is buoyant due to the closed cell foam tubing sections that wrap and surround the rigid frame members and part two is a support assembly that is comprised of length(s) of rope that weave through support sections that are comprised of additional members of rigid tube and or buoyant foam tube sections and attach to the rigid frame members to form a flexible, comfortable and customizable support. The additional features such as the ability to break down for shipment, customizability, the variety of models and user seating modes and suggestive selling products such as the optional headrest set it apart from the prior art. The present invention addresses all seven of the afore mentioned obvious benefits that a product in the current field of scope should offer by incorporating inexpensive materials in its production, ease of assembly with the use of few if any power tools which leads to a low carbon footprint, it can be packaged substantially flat or be broken down into smaller components for shipment, each of the similar yet different models are well designed for form and function, and will not pop or lose buoyancy. The present invention also offers the benefit of being available in different styles with different flotation characteristics and each style can be used in several different seating modes, each having the ability to be manipulated by the user to create customized comfort positions to fit any body type. The ability to carry the product on the shoulders leaves hands free to carry other pool or beach supplies. A total product weight of less than 2 pounds allows any user to carry the product regardless of size. All of these aspects combine to offer an original product that the marketplace has not seen, at the premium product level, with a substantial reduction in price. The invention is used by placing the floating chair in a body of water and sat or laid upon by a user, with the head of the user usually placed upon the headrest. The invention may be flipped over and the support assembly can adjusted to offer the user many different seating positions.

BRIEF DESCRIPTION OF THE SEVERAL VIEWS OF THE DRAWING

Various other objects, advantages, and features of the invention will become apparent to those skilled in the art from the following description taken in conjunction with the following drawings, in which.

DETAILED DESCRIPTION OF THE INVENTION

Figure 1:
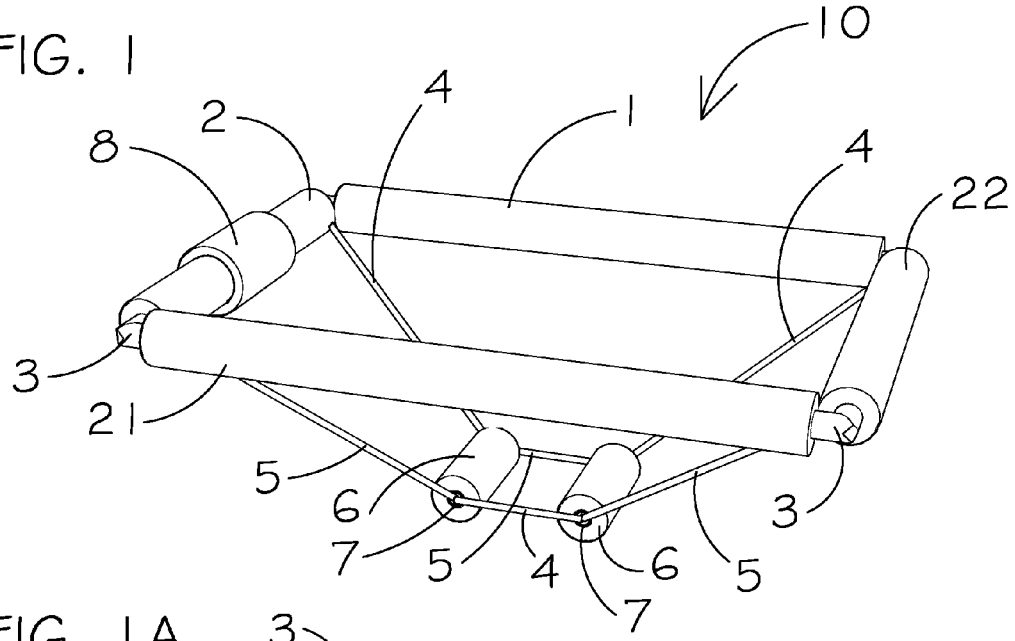
FIG. 1 is a perspective view from the side showing a substantially flat and rectangular version of the present invention with the support sections pushed near to each other causing slack in the flexible members.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 1A:
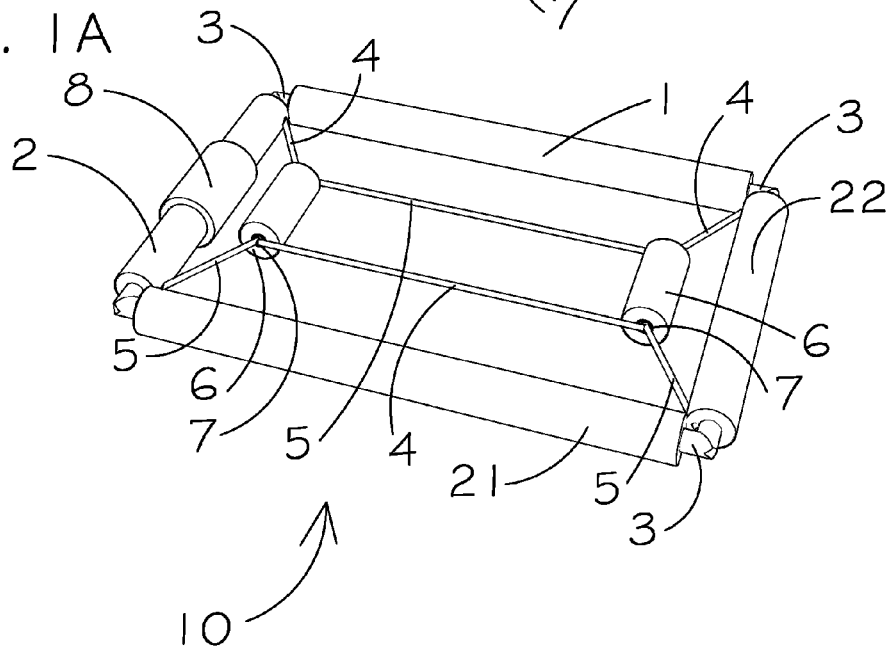
FIG. 1A is a perspective view from the side that shows the same apparatus in FIG. 1 depicting the support sections pushed apart toward the outer ends of the frame which removes the slack from the flexible members.
Figure 1B:
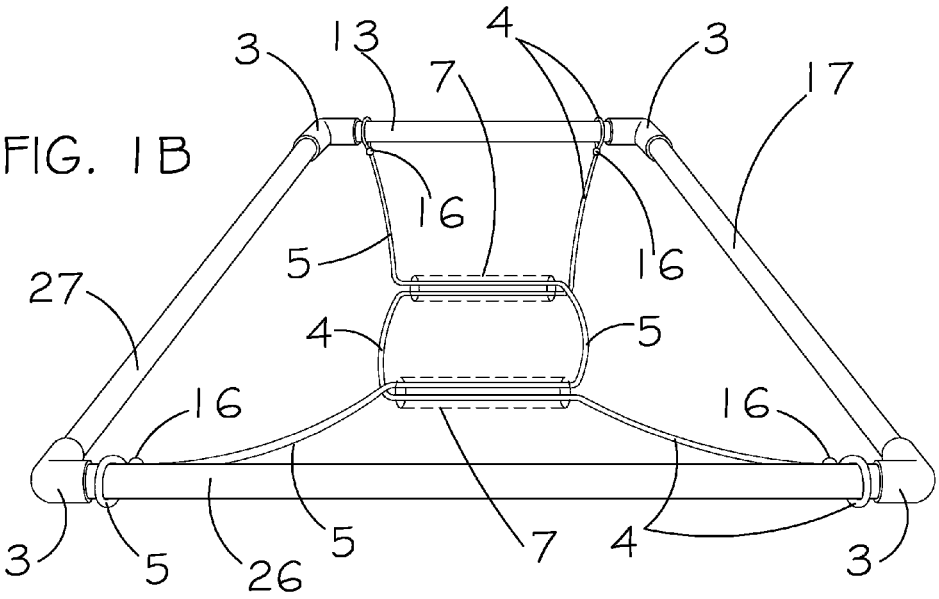
FIG. 1B is a depiction of the apparatus of FIG. 1 shown with all of the buoyant foam sections removed to make the rigid frame members and support members visible. In this view the knot or rope crimp becomes visible at the four points where flexible members are attached to the frame members.

Looking at FIG. 1, FIG. 1A and FIG. 1B together, you will see a version of the preferred embodiment 10 wherein FIG. 1 features the external members and FIG. 1B depicts preferred embodiment 10 with all of the buoyant foam sections removed to make the rigid frame members 13,17, 26 & 27 and tubular support members 7 visible. The outline of support members 7 has been shown as a hidden line to clearly show the path taken when flexible members 4 and 5 are weaved through the hollow of the tubular support members. In this view connection point 16 is a knot and becomes visible at the four points where flexible members 4 and 5 are attached to the frame members 13 & 26. One end of each flexible member 4 & 5 is attached to frame member 13 at connection points 16, the other ends of members 4 & 5 are routed through opposite hollow ends of one of the tubular support members 7, members 4 & 5 pass each other as they go through this same hollow. Note that support member 7 rests inside the hollow of support member 6. As the ends of 4 & 5 emerge from the opposite hollow ends, they are then routed through the opposing hollows of another tubular support member 7. As the ends of 4 & 5 emerge from the opposite end hollows of the second support member 7, they are affixed to the frame member 26 at connection knots 16. If one end of flexible member 4 was affixed to the right side of frame member 13, then the other end of flexible member 4 will be affixed to the right side of frame member 26. The four rigid frame members 13, 17, 26 & 27 (visible in FIG. 1B) composed of a rigid tube such as polyvinylchloride (pvc) are obscured by corresponding buoyant foam sections 2, 1, 22 & 21 that are composed of a lightweight, buoyant material such as expanded polyethylene (epe) or ethylene-vinyl acetate (eva) foam and sleeved over the said rigid frame members. The said frame members that are sleeved over with said foam sections are positioned to form a rectangle and four pvc elbow joints 3 are positioned in the four corners of the rectangle and affixed to each end of the shorter frame members 13 & 26 and the longer frame members 17 & 27 with a pvc cement to form a unified rectangular frame assembly. It should be noted that before assembling and gluing the parts, a larger buoyant foam tube 8 with a larger interior diameter may be fitted over one or more of the buoyant foam parts to provide additional flotation, or a headrest. The pre measured flexible members such as rope lengths 4 and 5 are affixed to the obscured frame members 13 & 26 at the attachment points 16 between elbow joint 3 and foam sections 2 & 22 and weaved through support sections 6 and 7 in a way that is visible in FIG. 1B and together make up the members of the support assembly. It should be noted that the support assembly simply falls into a lower position by way of gravity when the apparatus is flipped over and that the flexible members 4 & 5 are cut to a length that is long enough to allow the support assembly to hang below said buoyant frame assembly.

FIG. 1A is a perspective view from the side that depicts the same apparatus 10 in FIG. 1 that shows each support section pushed apart toward the outer ends of the frame which removes the slack from the flexible members 4 and 5 due to the technique used to weave the flexible members through the support sections visible in FIG. 1B. This causes the flexible members 4 & 5 to become taut to consolidate the apparatus and allow for easy storage and shipping.

Second Preferred Embodiment

Figure 2:
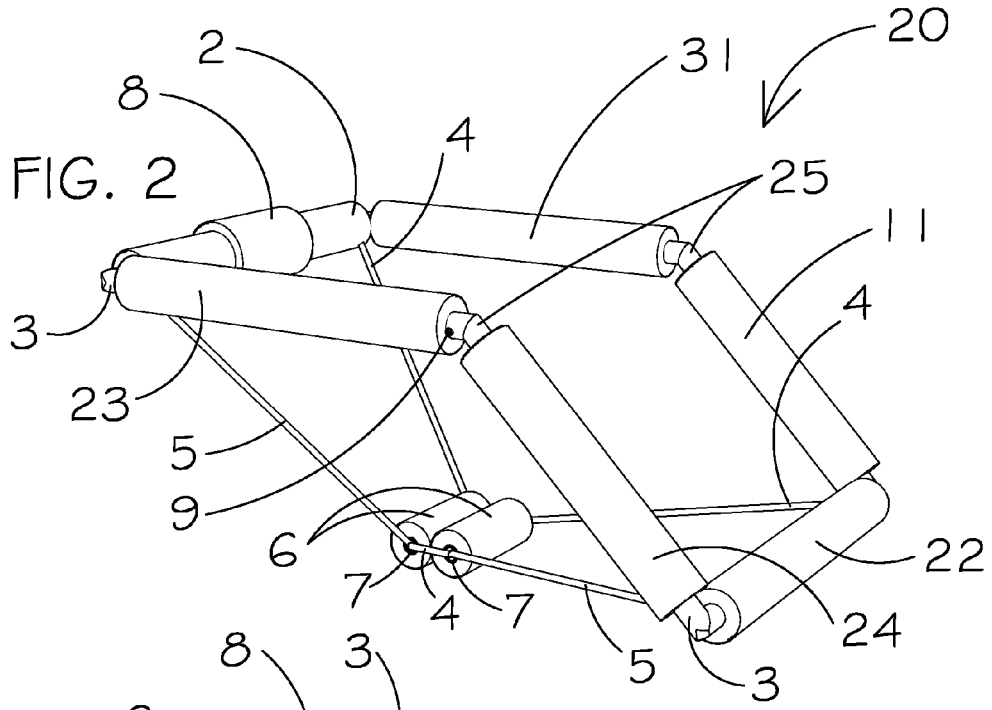
FIG. 2 shows a style variation of the apparatus in FIG. 1 in which the two lateral buoyant foam sections of FIG. 1 and underlying frame members of FIG. 1B have been changed to create the "armchair" version of the present invention.

Looking at FIG. 2, you will see the "armchair" version 20 of the invention, a variation of the apparatus in FIG. 1 in which the lateral buoyant foam sections 1 & 21 of FIG. 1 and underlying frame members 17 & 27 visible in FIG. 1B are replaced with shorter frame members 14, 15, 28 & 29 (Visible in FIG. 3B) and shorter foam sections 11, 23, 24 & 31 to form lateral sides of the frame assembly. Looking now at FIG. 3B, a forty-five degree pvc elbow joint 25 is adhered to frame member 15 with pvc cement and then attached to frame member 14 with a mechanical fastener 9, such as a stainless steel screw, to allow the frame to be disassembled at the joint member 25 for shipping and storage. The same assembly technique used for frame members 14, 15, and joint 25 are repeated with frame members 28, 29 and the remaining joint 25 and combined with the remaining parts of the rectangular apparatus 10 as depicted. One end of each flexible member 4 & 5 are attached to frame member 13 between foam section 2 and elbow joint 3, the other ends of members 4 & 5 are routed through opposite hollow ends of one of the tubular support members 7, they cross each other as they go through this same hollow. Note that tubular support member 7 rests inside the hollow of support member 6. As the ends of 4 & 5 emerge from the opposite end hollows, they are then routed through the opposing hollows of another support member 7. As the ends of 4 & 5 emerge from the opposite end hollows of the second support member 7, they are affixed to the frame member 26 at connection knot 16. If one end of flexible member 4 was affixed to the right side of frame member 13, then the other end of flexible member 4 will be affixed to the right side of frame member 26.

Figure 2A:
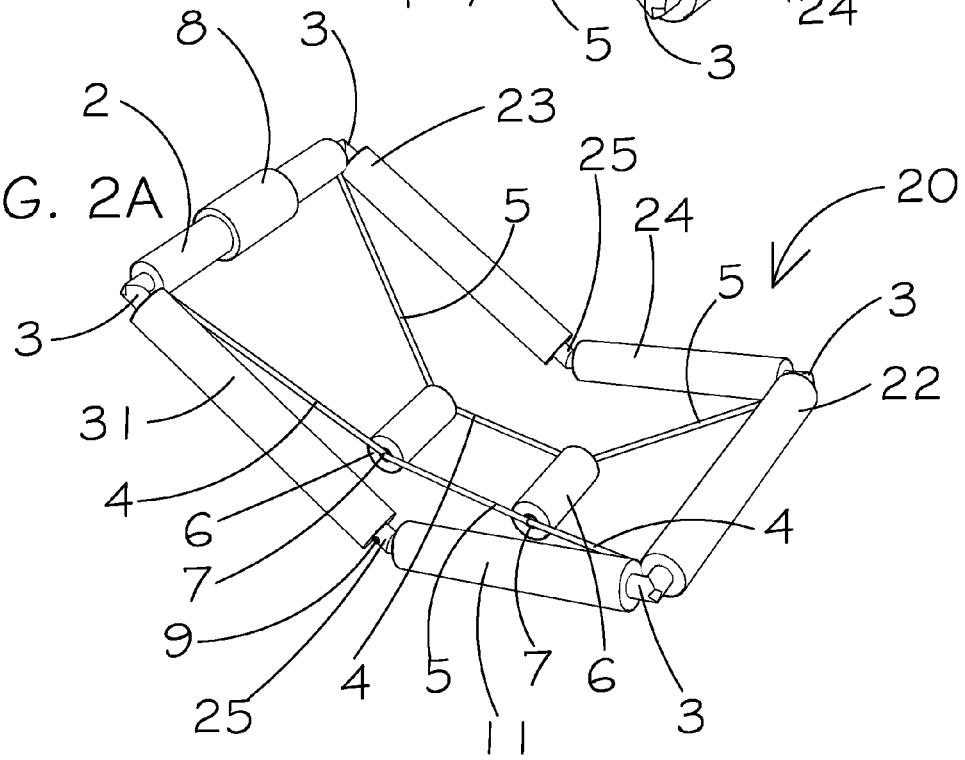
FIG. 2A shows the same apparatus as in FIG. 2 but turned upside down to form a "bucket seat" version with the two support sections pushed slightly apart to increase the tautness of the support ropes to demonstrate user customized adjustability.

In FIG. 2A, the same apparatus 20 as in FIG. 2 is turned upside down to form a "bucket seat" version with the two tubular support sections comprised of 6 and 7 pushed slightly apart to increase the tautness of the support ropes 4 and 5 to demonstrate user customized adjustability. The support sections can be adjusted with one at each end, both at one end, both in the middle and anywhere in between these three positions. It should be noted that the support assembly simply falls into a lower position by way of gravity when the device is flipped over and is of sufficient length to allow it to hang lower than the frame assembly.

Third Preferred Embodiment

Figure 3B:
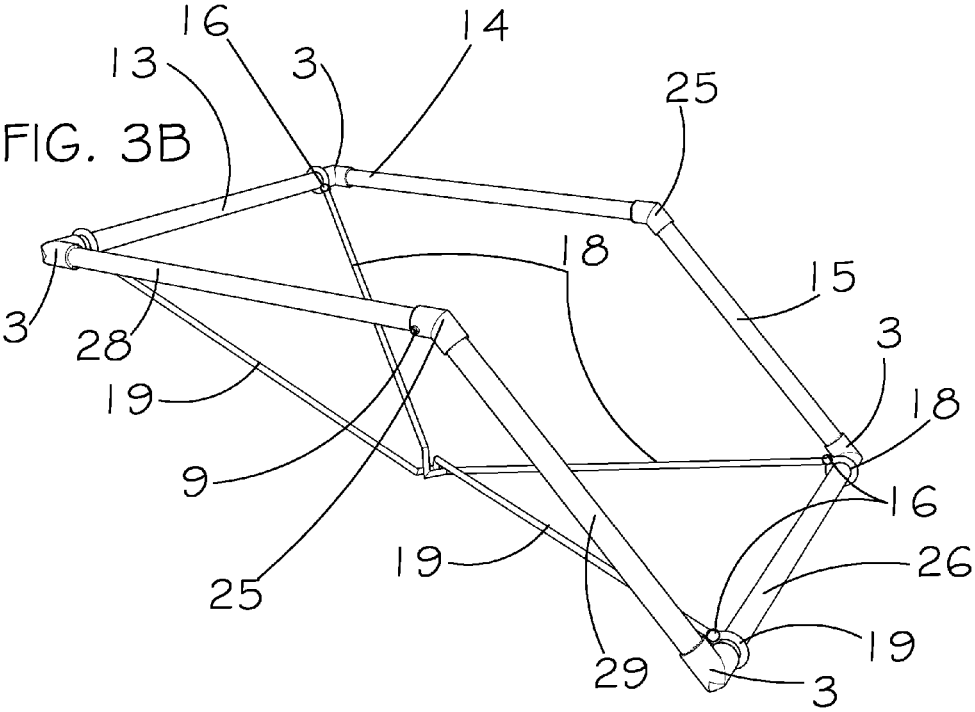
FIG. 3B is a perspective view of the apparatus of FIG. 3 with all of the buoyant foam sections removed to expose the rigid frame members and flexible support members beneath. The path and situation of the flexible support members are visible.
Figure 1C:
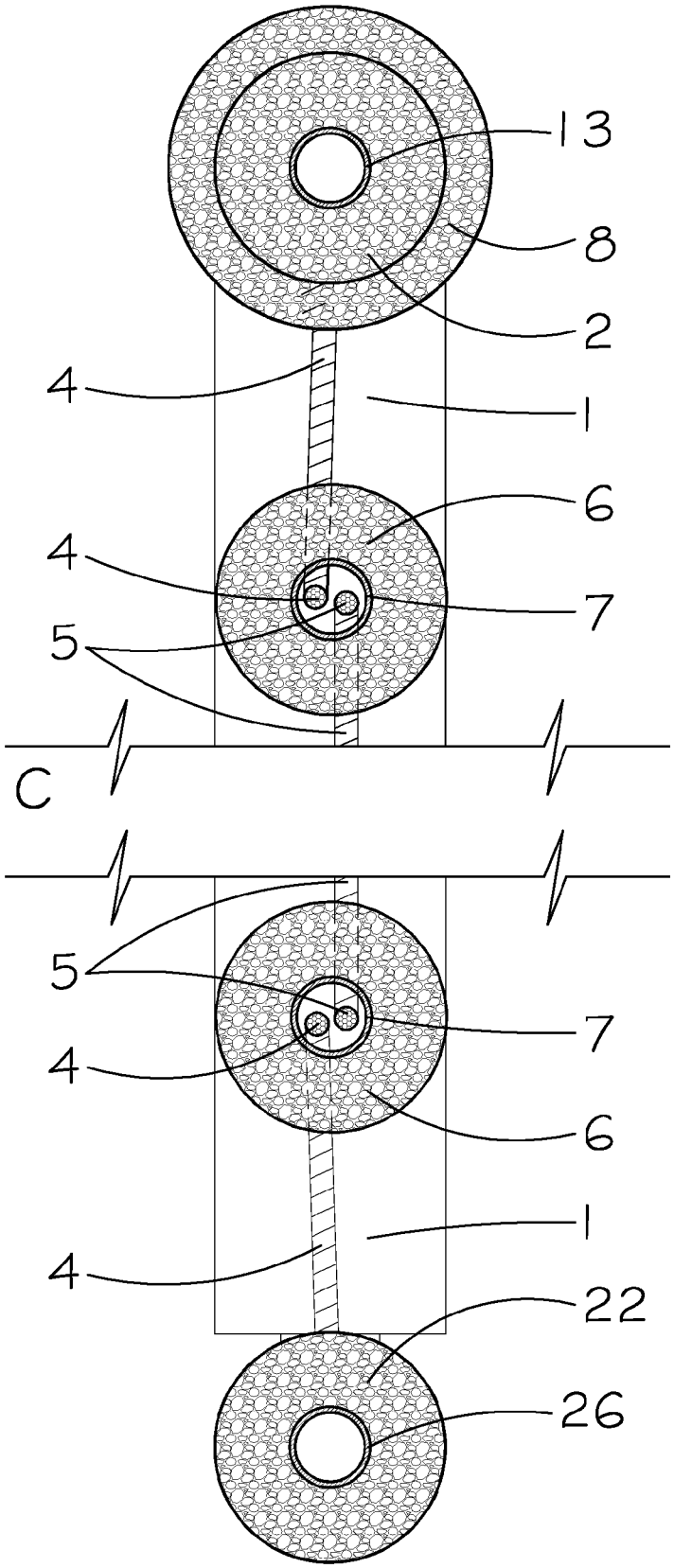
FIG. 1C is a cross section view of the rectangular apparatus of FIG. 1A that cuts through buoyant foam headrest, rigid frame members with sleeved buoyant foam sections, and the four support assembly members with the support flexible members weaved through the hollows of support members.
Figure 3:
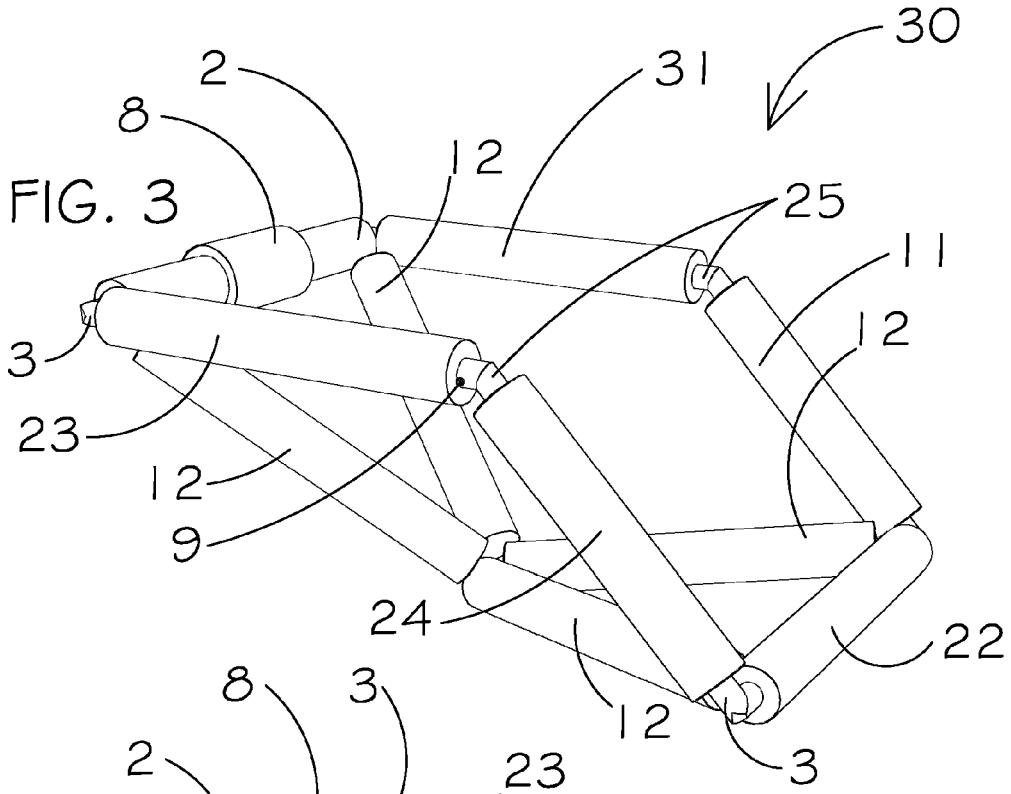
FIG. 3 is a perspective view from the side showing a high buoyancy version of the present invention similar to the apparatus in FIG. 2 wherein the use of and orientation of frame members, buoyant foam sections, elbow joints, mechanical fastener and headrest are shared but there is a variation in the support assembly.
Figure 3A:
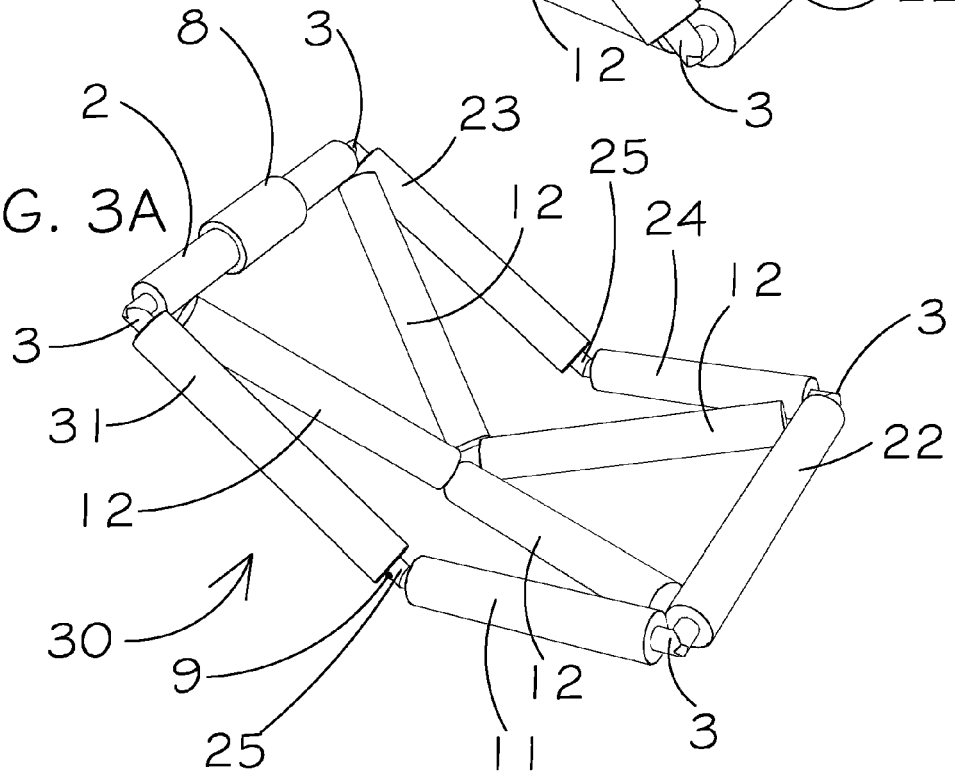
FIG. 3A is a perspective view from the side depicting the same high buoyancy apparatus of FIG. 3, however, it is flipped upside down where the support assembly is then pushed downward to form a high buoyancy "bucket seat" version of the present invention.

FIG. 3 is a perspective view from the side showing a high buoyancy version 30 of the present invention similar to the apparatus 20 in FIG. 2 wherein the frame members 13, 14, 15, 26, 28, & 29 (visible in FIG. 3B), buoyant foam sections 2, 11, 22, 23, 24 & 31 elbow joints 3, 25, mechanical fastener 9 and headrest 8 are shared between apparatus 20 and apparatus 30. Flexible members 18 and 19 that attach to one short member 13 of the rigid frame, are each weaved through the hollow of a section of buoyant foam 12, they then cross and overlap one another in the middle and each pass through another section of buoyant foam 12, before re-attaching to the other short frame member 23 to form an "X" in the interior frame region. If one end of flexible member 18 was affixed to the right side of frame member 13, then the other end of flexible member 18 will be affixed to the right side of frame member 26. This forms a semi rigid, yet flexible support assembly that incorporates a larger amount of buoyant foam to offer increased flotation for those users with a body type that is high in lean muscle and low in body fat as an example. In FIG. 3A, the same high buoyancy apparatus 30 of FIG. 3 is flipped upside down where the support assembly of flexible members 18 and 19 within buoyant tubing 12 are pushed downward to form a high buoyancy "bucket seat" version of apparatus 30.

FIG. 3B shows all of the buoyant foam sections 2, 11, 12, 22, 23, 24 & 31 of apparatus 30 removed to expose the rigid frame members 13, 14, 15, 26, 28 & 29 and flexible members 18 and 19 beneath. The path and situation of the flexible members 18 and 19 are visible. The attachment area 16 may be a knot in the support rope or a rope crimp device and are attached to the frame members 13 & 26. It is important to note that the six frame members 13, 14, 15, 26, 28, 29, the four elbow joints 3, along with the two forty-five degree joints 25 are used and assembled in the same way for the two similar devices depicted in FIG. 2 and FIG. 3

Fourth Preferred Embodiment

Figure 4:
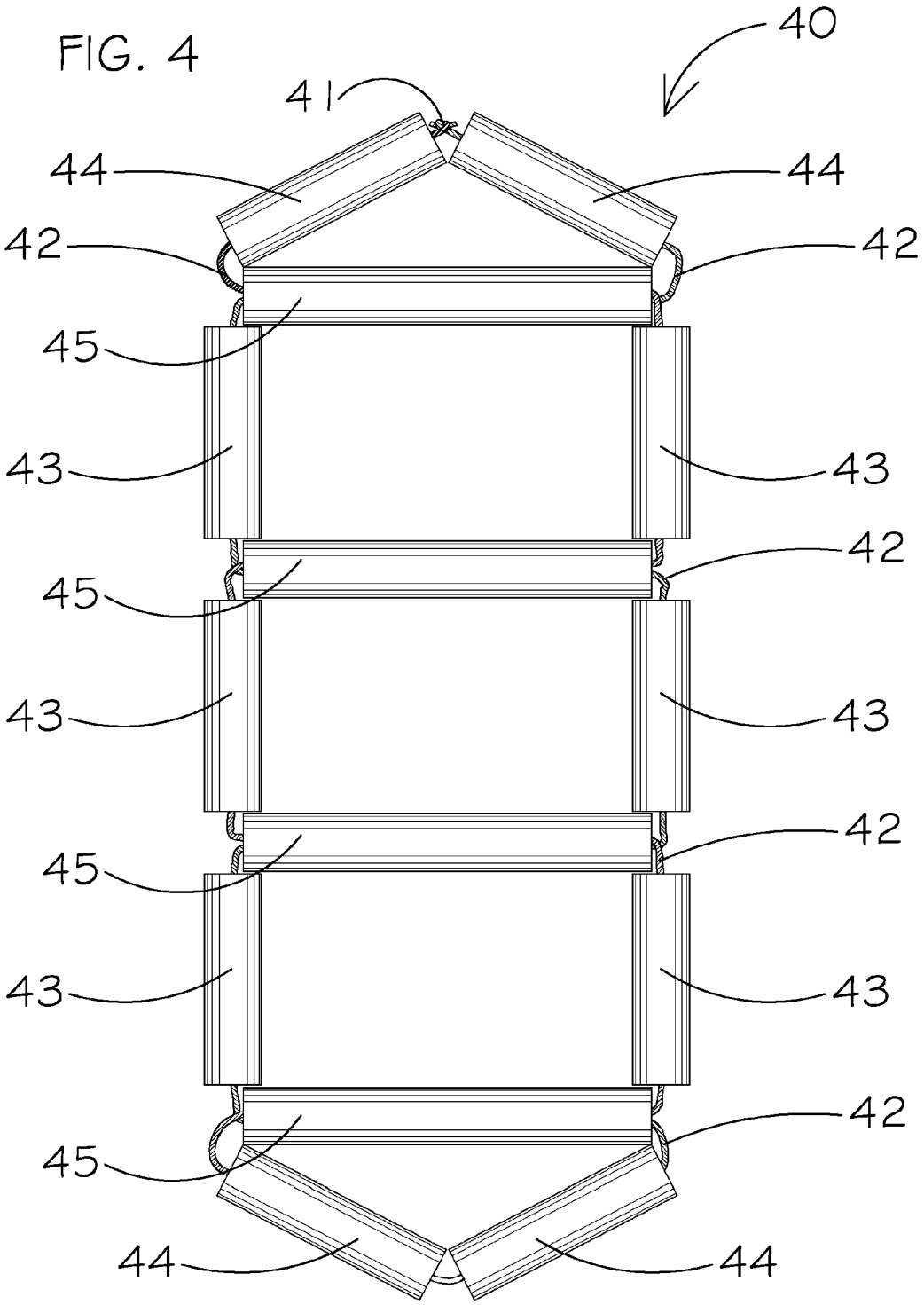
FIG. 4 shows yet another version of the present invention where there is no use of rigid frame members and the buoyant foam tubes are only held together with a length of flexible member that is coursed through the hollows of said buoyant foam tubes and connected back to itself.
Figure 4A:
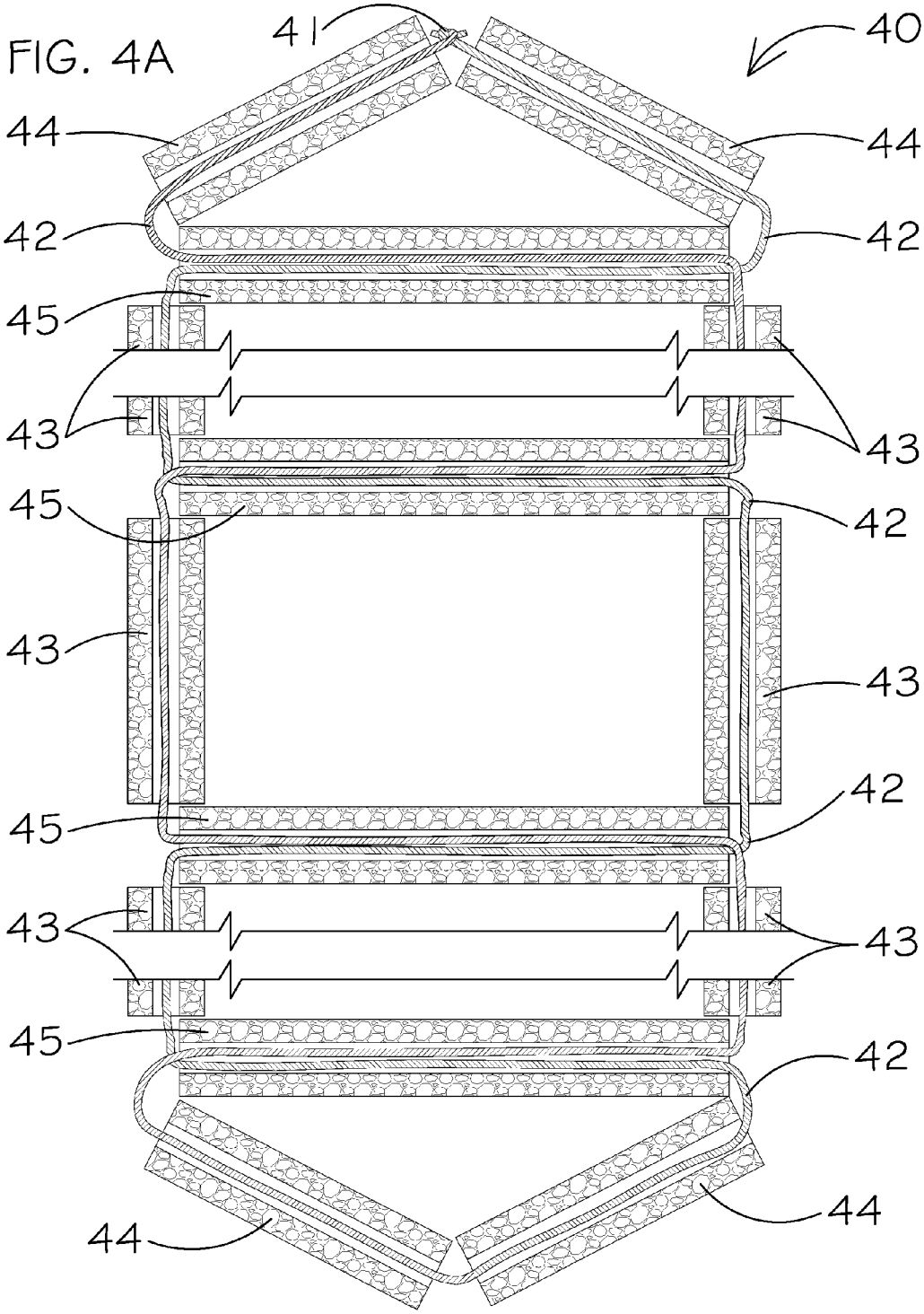
FIG. 4A shows the same apparatus of FIG. 4 as if all of the buoyant foam members have been cut in half lengthwise and the top halves removed to illustrate the path taken by the flexible member through the hollows of said buoyant tubes.

Looking at FIG. 4 and FIG. 4A together, you will see another embodiment 40 of the present invention where there is no use of rigid frame members. The six buoyant foam sections 43, four buoyant foam sections 44, and four buoyant foam sections 45 are joined together using at least one flexible member 42 that is routed through the hollows of all buoyant foam sections and then fastened back to itself at point 41 in the form of a knot or mechanical connecter. The said route of flexible member 42 is exposed in the section view FIG. 4A which shows how one end of the flexible member is routed through the hollow of a lower tube section 44 and the other end of 42 is routed similarly through a second lower tube 44. The two ends of 42 cross each other as they are routed through opposing end hollows of a tube section 45. As the ends of 42 emerge from the opposite end hollows of foam section 45, they are each routed up through the hollows of two foam sections 43. The ends of flexible member 42 repeat this routing process as illustrated in FIG. 4A until they are passed through the hollows of the last two buoyant foam sections 44, it is there that the two opposing ends of flexible member 42 meet and are connected together to form a continuous loop. The flexible nature of member 42 allows the buoyant foam sections to be folded at all junctions to minimize the overall size of embodiment 40. The resulting embodiment of the present invention is exceptionally light weight, completely flexible, can be folded into a small area for packaging and storage, and can be worn on the user's body during use in water.

Fifth Preferred Embodiment

Figure 5:
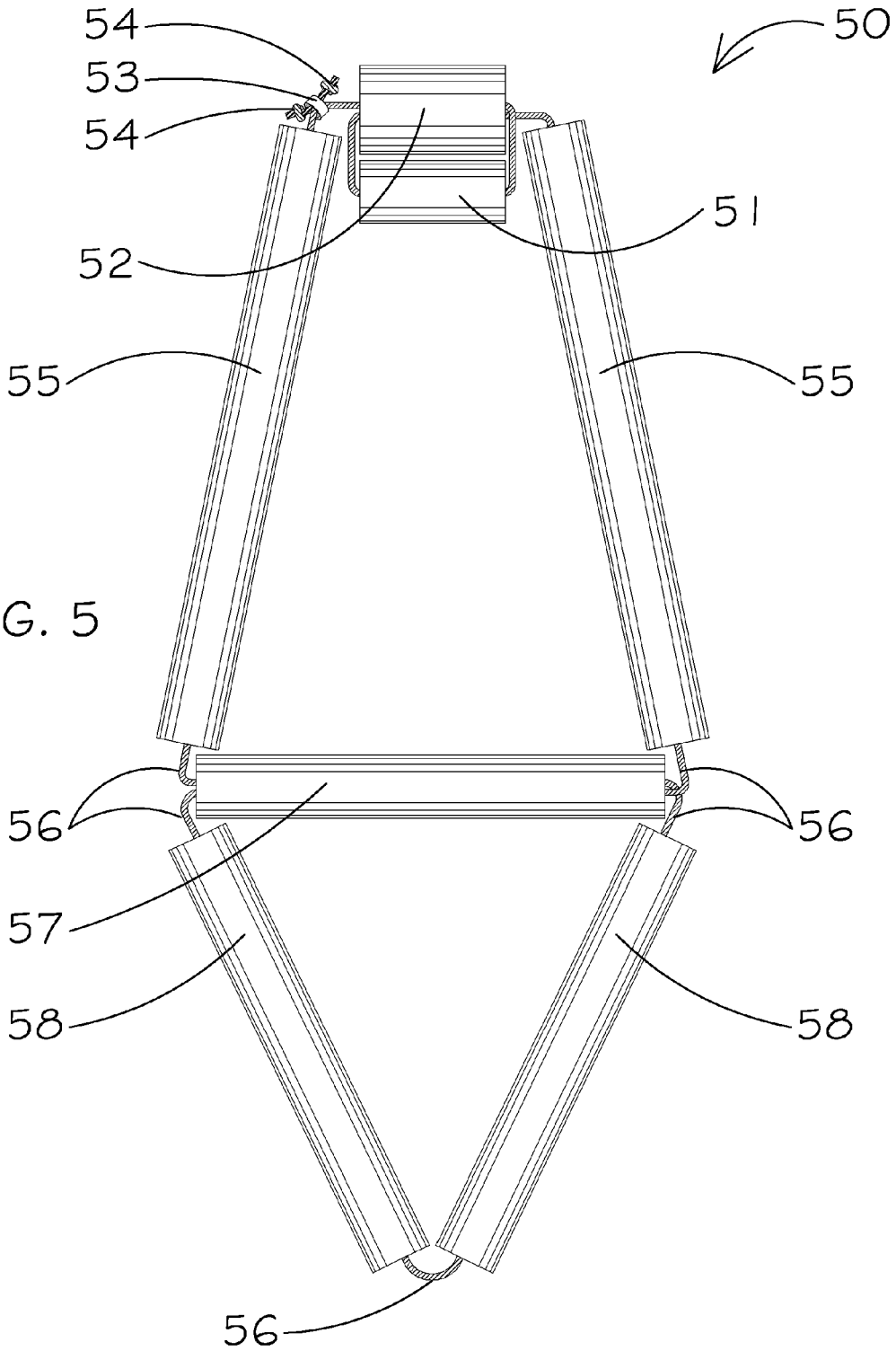
FIG. 5 shows another version of the present invention that is similar to that of FIG. 4 where there is no use of rigid frame members and the buoyant foam tubes are only held together with a length of flexible member that is coursed through the hollows of said buoyant foam tubes and connected back to itself.
Figure 5A:
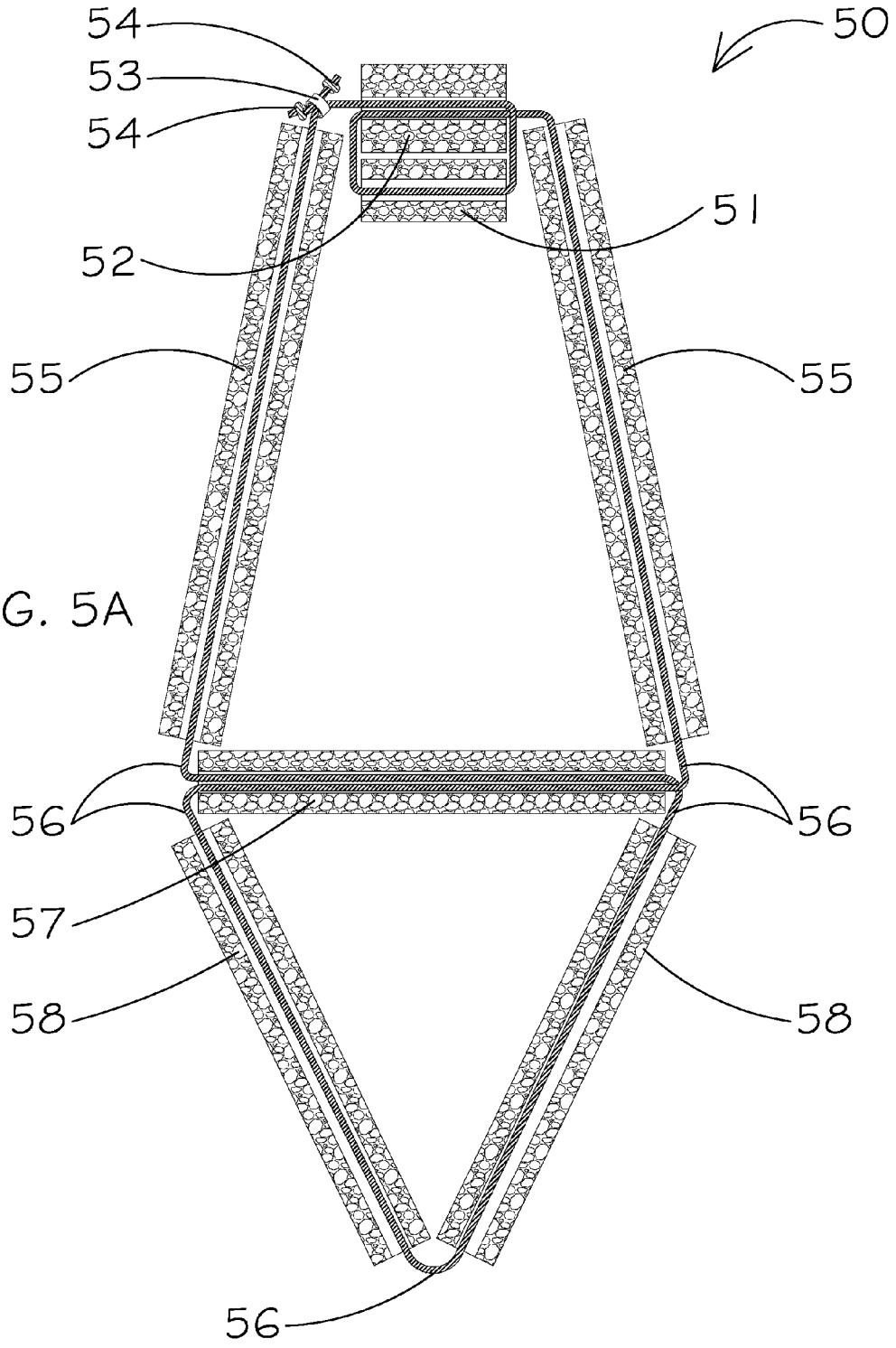
FIG. 5A shows the same apparatus of FIG. 5 as if all of the buoyant foam members have been cut in half lengthwise and the top halves removed to illustrate the path taken by the flexible member through the hollows of said buoyant tubes.

Looking at FIG. 5 and FIG. 5A together, you will see another embodiment 50 of the present invention where there is no use of rigid frame members. The two upper buoyant foam sections 55, two lower buoyant foam sections 58, head rest buoyant foam sections 51, 52, and hinge buoyant foam section 57 are joined together using at least one flexible member 56 that is routed through the hollows of all buoyant foam sections and then fastened back to itself using a fastening method. The preferred fastening method illustrated in FIGS. 5 and 5A is a mechanical connecter or ring 53 and two knots 54. Once the flexible member 56 is routed through all of the buoyant foam sections, each end of member 56 is passed through the hollow of ring 53 and an overhand knot is tied on each end of member 56. The interior diameter of ring 53 is of sufficient size to allow only the diameters of both ends of member 56 to pass through its hollow easily but prohibits these ends from being removed once the overhand knots have been applied. This ring and knot fastener system allows for reduced packing size and shipping cost due to partial assembly during manufacture and a very easy reassembly by the end user. The said route of flexible member 56 is exposed in the section view FIG. 5A which shows how one end of the flexible member 56 is routed through fastener ring 53, down through the hollow of the left side upper tube section 55, through hinge tube 57, down through the right lower tube 58, up through the left lower tube 58, back through hinge tube 57, up through the right side upper tube section 55, through head rest tube section 52, through head rest section 51, back through head rest section 52, and back through the other side of fastener ring 53, where the overhand knots 54 are tied at each end of flexible member 56 effectively unifying all of these members as one preferred embodiment 50. The hinge buoyant foam section is called so because the two lower foam sections 58 can be rotated up with member 57 acting as the pivot point, so that they nest between upper members 55 to minimize the overall size of embodiment 50. The shape of embodiment 50 is essentially two triangles, which hold shape well without a rigid framework, which is preferable over a square shape for example. The resulting embodiment of the present invention has a minimum of parts, is exceptionally light weight, completely flexible, can be folded into a small area for packaging and storage, and can be worn on the user's body during use in water.

How a Person Rests in the Seat

Figure 6:
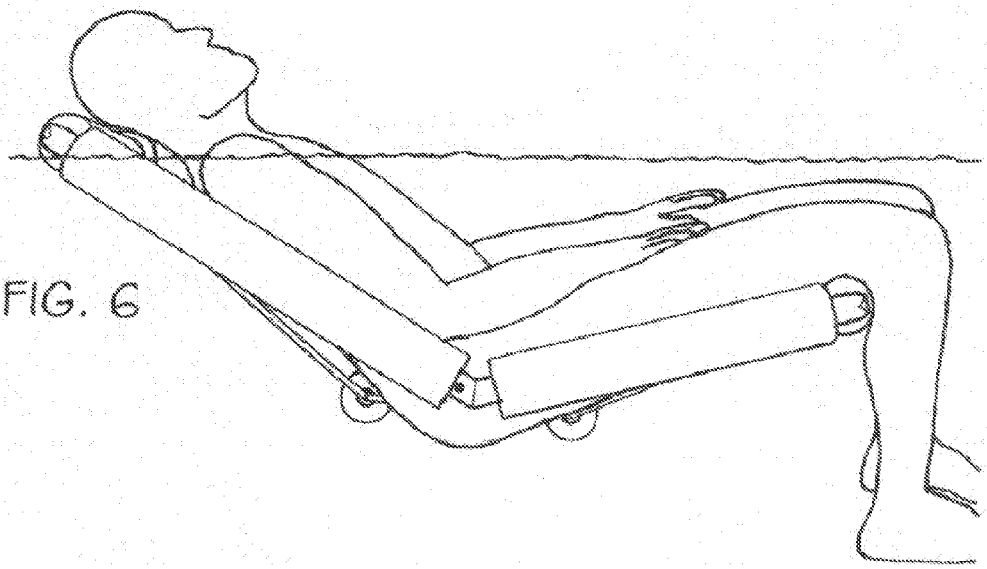
FIG. 6 Depicts a user seated in a reclined position in the second preferred embodiment of the present invention.
Figure 7:
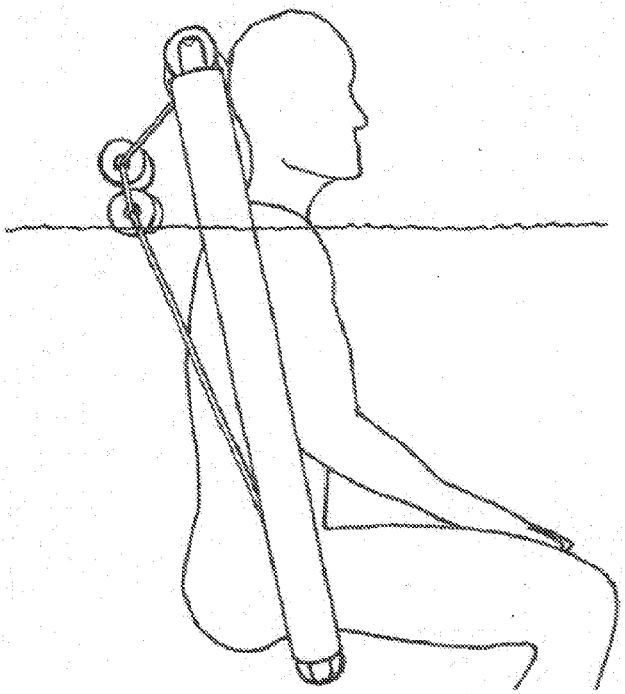
FIG. 7 Depicts a user seated in an upright position in the first preferred embodiment of the present invention.

A person may rest in the seat in a variety of ways. A user would typically enter into a body of water and arrange the tubular support sections 6 &7 into the middle of the surrounding frame and place their rear end onto the support sections, with their head at one short end of the frame and their feet at the other short end of the frame and rest in a reclined position as demonstrated in FIG. 6. A user may shift their weight forward, placing their rear end on the lower frame members 22 & 26 to sit in an upright position as demonstrated in FIG. 7. Some users may prefer to lay facing the apparatus. The apparatus may be flipped over, or turned upside down to provide other flotation characteristics or seating options that may be preferred by the user.

Method of Assembly

In order to manufacture or produce the floating chair invention depicted in FIG. 1 and FIG. 1A, first, all parts shown must be sized, cut and or otherwise procured. The optional buoyant foam headrest 8 is sleeved over the buoyant foam section 2, then frame member 13 is inserted into the hollows of foam section 2 which carries the headrest 8. The inside of one hollow end of a ninety-degree pvc elbow joint 3 is coated with pvc cement and applied to each end of the frame member 13, so that the two open ends of the elbow joints 3 face in the same direction and are parallel when viewed from the side or laid onto a horizontal surface to rest on the open ends of parts 3. This same assembly is repeated with frame member 26, foam section 22 and the remaining two elbow joints 3 without headrest 8. Rigid frame members 17 are inserted through the hollow of buoyant foam sections 1 and are then inserted into the remaining open ends of elbow joints 3 after coating the inside of remaining open ends of the elbow joints 3 with pvc cement. The resulting apparatus is a rectangular pvc pipe or tube frame that has all four frame members wrapped inside the hollow of buoyant foam tubing sections and are mainly obscured from sight. Looking at FIG. 1, one end of rope length 4 is affixed to the right side of upper frame member 13 between foam section 2 and upper right elbow joint 3 by looping the rope length 4 around frame member 13 and tying a knot or applying a rope crimp 16. As illustrated in FIG. 1B, the other end of rope length 4 is passed through the right side hollow end of the topmost support assembly, (made of rigid tube member 7 inserted into buoyant tube section 6) and out the left side of the hollow moving from right to left. Rope length 4 is then brought down and through the hollow of the remaining support member 7 from left to right, out of the hollow and down to be attached to the right side of lower frame member 26 via a knot or rope crimp 16. Looking again at FIG. 1 with the headrest 8 at the top, one end of rope length 5 is affixed to the left side of upper frame member 13 between foam section 2 and upper left elbow joint 3 by looping the rope length 5 around frame member 13 and tying a knot or applying a rope crimp 16. As illustrated in FIG. 1B, the other end of rope length 5 is passed through the left side hollow end of the topmost support member and out the right side of the hollow moving from left to right. Rope length 4 is then brought down and through the hollow of the remaining support member from right to left, out of the hollow and down to be attached to the left side of lower frame member 26 via a knot or rope crimp 16. The resulting apparatus is the rectangular buoyant frame and headrest, with attached flexible members and adjustable support sections that form the support assembly, as illustrated in FIG. 1 and FIG. 1A.

The production and assembly of the embodiments depicted in FIG. 2 and FIG. 3 are substantially similar to that of the production of the apparatus of FIG. 1 and FIG. 1A above. The notable differences being that instead of one long frame member inserted into one long buoyant foam tube length at each lateral side, there are two frame members inserted into two separate buoyant foam tube lengths, with the frame members being joined together by a forty-five degree pvc elbow joint 25 via pvc adhesive at one end of the elbow joint and a mechanical fastener 9 at the other. This mechanical fastener 9 makes it possible to break down the apparatus into a smaller form for shipping and storage. The apparatus should not be limited to any material types or part sizes.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A floating seat, comprising:

a buoyant seat frame having at least a first frame portion comprising at least three and at most four tubular buoyant frame members arranged substantially end to end to define a first polygon with each single frame member defining a side of said first polygon and a second frame portion comprising at least three and at most four tubular buoyant frame members arranged substantially end to end to define a second polygon with each single frame member defining a side of said second polygon, each said frame member being a discrete unitary segment, such that said first polygon shares a side defined by a shared tubular buoyant frame member with said second polygon, said frame members excluding said shared tubular buoyant frame member together forming a loop enclosing a frame interior region between them, said frame members interconnected by at least one flexible member having a continuous one piece structure and extending axially through each said tubular buoyant frame member of said first and second frame portions, wherein said at least one flexible member connects back to itself to form a buoyant loop and wherein said shared tubular buoyant frame member extends across the frame interior region for supporting a person seated in said frame.

2. The floating seat of claim 1, wherein said at least one flexible member is formed of rope.

3. The floating seat of claim 1, wherein said flexible member has two member ends and forms a loop by connecting back to itself with interconnection means comprising a ring, through which both member ends of said flexible member pass before a knot is tied on each of said ends;

and the interior diameter of said ring is of sufficient size only to allow the diameter of the two flexible member ends to pass through, said ring prohibiting the said flexible member ends from passing once the knot has been tied at each of the ends.

4. The floating seat of claim 1, wherein said seat frame comprises is a triangular shaped seat area made of at least three buoyant frame members, an upper rest area made of at least two buoyant frame members, and a headrest area made of at least one buoyant frame member.

5. The floating seat of claim 1, additionally comprising a tubular support member.

6. The floating chair of claim 1, wherein said at least one flexible member is a single flexible member.

7. The floating chair of claim 1, wherein said at least one flexible member comprises two separate flexible members.

8. The floating seat of claim 1, wherein at least two of said tubular buoyant frame members have different lengths.

9. A floating seat, comprising:

a buoyant seat frame having at least a first frame portion comprising at least three and at most four tubular frame members arranged substantially end to end to define a first polygon with each single frame member defining a side of said first polygon and a second frame portion comprising at least three and at most four tubular frame members arranged substantially end to end to define a second polygon with each single frame member defining a side of said second polygon, each said frame member being a discrete unitary segment, such that said first polygon shares a side defined by a shared frame member with said second polygon, said frame members excluding said shared frame member together forming a loop enclosing a frame interior region between them, said frame members interconnected by at least one flexible member having a continuous one piece structure and extending axially through each said tubular frame member of said first and second frame portions to form a frame interior region;

wherein said at least one flexible member connects back to itself to form a loop and wherein said shared frame member extends across the frame interior region for supporting a person seated in said frame;

and wherein said tubular frame members are buoyant.

10. The floating seat of claim 9, wherein said seat frame is substantially rectangular, and wherein said at least one flexible member is connected to said frame substantially at each of said frame corners and extends across the middle of the frame interior region between opposing frame corners.

11. The floating seat of claim 9, wherein said tubular frame members comprise tubular buoyant foam sections.

12. The floating seat of claim 9, wherein the loop is a closed loop.

13. The floating seat of claim 9, wherein said frame members are formed of polyvinyl chloride.

14. The floating seat of claim 9, wherein said frame members each comprises a tubular buoyant foam section for increasing buoyancy at a selected location and to provide a cushion.

15. The floating seat of claim 9, wherein said at least one flexible member is formed of rope.

16. The floating seat of claim 9, wherein said tubular frame members each comprises a tubular buoyant foam section fitted around said at least one flexible member.

17. The floating seat of claim 9, wherein said at least one flexible member comprises a plurality of flexible members, and wherein said plurality of flexible members pass through at least one tubular support section from opposing ends of said tubular support section.

18. The floating seat of claim 9, wherein said detach from one another to allow the frame to break down into smaller sections.

19. The floating seat of claim 9, wherein said at least one flexible member can be adjusted to serve as shoulder straps that provide means for carrying the said floating chair on a users back as one would carry a back pack.

20. The floating seat of claim 9, additionally comprising a tubular support member.

21. The floating seat of claim 9, wherein at least two of said tubular frame members have different lengths.

* * * * *